US009422096B1

(12) United States Patent
Hsiao et al.

(10) Patent No.: US 9,422,096 B1
(45) Date of Patent: Aug. 23, 2016

(54) PACKAGE CUSHIONING MATERIAL FOR LIQUID CRYSTAL GLASS

(71) Applicant: Shenzhen China Star Optoelectronics Technology Co., Ltd., Shenzhen, Guangdong Province (CN)

(72) Inventors: Yuchun Hsiao, Shenzhen (CN); Yicheng Kuo, Shenzhen (CN); Yue Wu, Shenzhen (CN)

(73) Assignee: SHENZHEN CHINA STAR OPTOELECTRONICS TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/159,795

(22) Filed: May 19, 2016

Related U.S. Application Data

(62) Division of application No. 13/704,241, filed on Dec. 13, 2012, now Pat. No. 9,371,170.

(30) Foreign Application Priority Data

Sep. 28, 2012 (CN) ..... 2012 1 0370644

(51) Int. Cl.

| | |
|---|---|
| ***B65D 81/02*** | (2006.01) |
| ***B65D 85/48*** | (2006.01) |
| ***B65D 81/03*** | (2006.01) |
| ***B65D 81/05*** | (2006.01) |
| ***B65D 81/107*** | (2006.01) |

(52) U.S. Cl.
CPC ..... *B65D 81/03* (2013.01); *B65D 81/052* (2013.01); *B65D 81/107* (2013.01); *B65D 81/053* (2013.01); *B65D 81/054* (2013.01); *B65D 81/055* (2013.01); *B65D 85/48* (2013.01)

(58) Field of Classification Search
CPC ..... B65D 81/03; B65D 81/052–81/055; B65D 85/48; B65D 81/057; B65D 81/107; B65D 71/04
USPC ..... 206/453, 522, 523, 586, 591, 592, 594; 383/3
See application file for complete search history.

(56) References Cited

U.S. PATENT DOCUMENTS

| | | | | |
|---|---|---|---|---|
| 7,588,148 | B2 * | 9/2009 | Yang | B65D 5/5069 206/523 |
| 7,631,762 | B2 * | 12/2009 | Liao | B65D 81/052 206/522 |
| 8,215,484 | B2 * | 7/2012 | Lim | B65D 81/058 206/592 |
| 2003/0155273 | A1 * | 8/2003 | Myers | B65D 81/057 206/586 |
| 2006/0032779 | A1 * | 2/2006 | Tanaka | B65D 81/052 206/522 |

(Continued)

*Primary Examiner* — Luan K Bui
(74) *Attorney, Agent, or Firm* — Cheng-Ju Chiang

(57) ABSTRACT

A package cushioning material for liquid crystal glass includes two air sack sheets arranged on and parallel with two major surfaces of a piece of liquid crystal glass and two scratch protection layers in the form of U-shaped channels formed of a foamed cushioning material and arranged at two opposite ends of the liquid crystal glass to separate the air sack sheets from the ends of the liquid crystal glass. The air sack sheet is formed by connecting a plurality of air sacks. The package cushioning material uses an air sack sheet as a basic cushioning material that is protected from being damaged by the corners of the ends of the liquid crystal glass by being separated from the corners of the liquid crystal glass by the scratch protection layers.

11 Claims, 4 Drawing Sheets

(56) References Cited

U.S. PATENT DOCUMENTS

2008/0159659 A1* 7/2008 Liao ..... B65D 81/052 383/3
2009/0230009 A1* 9/2009 Ogburn ..... B65D 85/48 206/453
2009/0250367 A1* 10/2009 Murdoch ..... B65D 81/053 206/453
2011/0183089 A1* 7/2011 Kuo ..... B65D 81/055 428/34.1
2012/0031807 A1* 2/2012 Shimomichi ..... B65D 81/053 206/586

* cited by examiner

PACKAGE CUSHIONING MATERIAL FOR LIQUID CRYSTAL GLASS

CROSS REFERENCE TO RELATED APPLICATIONS

This is a divisional application of co-pending patent application Ser. No. 13/704,241 filed on Dec. 13, 2012, U.S. Pat. No. 9,371,170 which is a national stage patent application of PCT application No. PCT/CN2012/083164, filed on Oct. 19, 2012, claiming foreign priority of Chinese application No. 201210370644.0, filed on Sep. 28, 2012. Disclosure of the above is incorporated by reference herein.

BACKGROUND OF THE INVENTION

1. Field of the Invention

The present invention relates to the field of packaging material, and in particular to a package cushioning material for liquid crystal glass.

2. the Related Arts

In the field of manufacture of liquid crystal display devices, the manufacture of liquid crystal display devices includes a process of assembling, which puts various components, including a liquid crystal glass, a main control circuit, and an enclosure, together. These components are each manufactured in advance and packaged for being later assembled to form a complete liquid crystal display device. The liquid crystal glass, after being manufactured, is packaged in a package box that is filled with cushioning materials and then shipped in box to a corresponding assembling station. The purposes of the cushioning materials are to prevent mechanical damage caused by external forces from occurring on the liquid crystal glass in transportation processes including loading and unloading and shipping. Package cushioning materials are generally of two types, including plastic cushioning material and paper cushioning material. Air sacks are a novel material for serving as package cushioning materials for liquid crystal glass and are each composed of two layers of plastic films between which air is filled to make a package cushioning material that is of excellent elasticity.

However, in using air sacks directly as a package cushioning material for liquid crystal glass, as shown in FIG. 1, the four corners 302 of a piece of liquid crystal glass 300 are positioned directly on the air sacks 100. During loading/unloading and shipping of the liquid crystal glass 300, due to shaking and vibration caused by external forces, the corners 302 may scratch and break the air sacks 100, making the air sacks 100 losing the capability of cushioning and eventually leading to damage of the liquid crystal glass 300.

SUMMARY OF THE INVENTION

An object of the present invention is to provide a package cushioning material for liquid crystal glass, which comprises air sacks as a basic material used in combination with scratch protection layers arranged at contact sites of four corners of a piece of liquid crystal glass to prevent direct contact of the liquid crystal glass with the air sacks that causes scratch and break of the air sacks, whereby the air sacks may make full use of the cushioning capability thereof to achieve highly effective protection of liquid crystal glass in the process of shipping.

To achieve the object, the present invention provides a package cushioning material for liquid crystal glass, which comprises an air sack sheet and scratch protection layers arranged at contact sites of the air sack sheet with four corners of the liquid crystal glass. The air sack sheet is formed by connecting a plurality of air sacks.

The air sacks each comprise two end faces and a columnar face connecting between the end faces. The columnar faces of the plurality of air sacks are jointed to each other.

The air sack sheet is integrally formed.

The air sack sheet is of an annulus configuration.

The scratch protection layers are single-sided adhesive tapes adhered to portions of the air sack sheet that correspond to the four corners of the liquid crystal glass.

The scratch protection layer are thin films attached the four corners of the liquid crystal glass.

The thin films comprise PE films or PET films.

The air sack sheet is of a plate-like configuration.

The scratch protection layers are made of a foamed PE cushioning material and form U-shaped channels corresponding to the liquid crystal glass. The U-shaped channels have a width greater than or equal to thickness of the liquid crystal glass.

The air sack sheet comprises two pieces respectively connected to two ends of two scratch protection layers.

The present invention further provides a package cushioning material for liquid crystal glass, which comprises an air sack sheet and scratch protection layers arranged at contact sites of the air sack sheet with four corners of the liquid crystal glass, the air sack sheet being formed by connecting a plurality of air sacks;

wherein the air sacks each comprise two end faces and a columnar face connecting between the end faces, the columnar faces of the plurality of air sacks being jointed to each other;

wherein the air sack sheet is integrally formed;

wherein the air sack sheet is of an annulus configuration; and wherein the scratch protection layers are single-sided adhesive tapes adhered to portions of the air sack sheet that correspond to the four corners of the liquid crystal glass.

The efficacy of the present invention is that the present invention provides a package cushioning material for liquid crystal glass, which uses an air sack sheet as a basic material to be used in combination with scratch protection layers arranged at contact sites of the air sack sheet with the four corners of the liquid crystal glass so as to prevent the liquid crystal glass from scratching and breaking the air sacks thereby providing improved effect of cushioning and thus highly effective protection of the liquid crystal glass during transportation.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
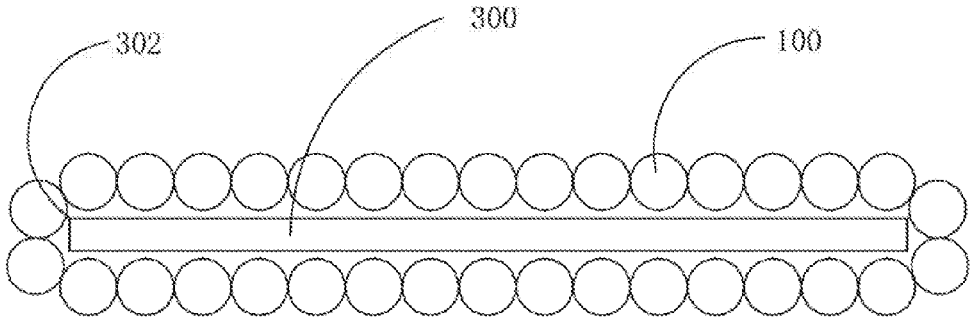
Fig. 1 (Prior Art)
FIG. 1 is a schematic view illustrating a package where air sacks are used directly as a package cushioning material.
Figure 2:
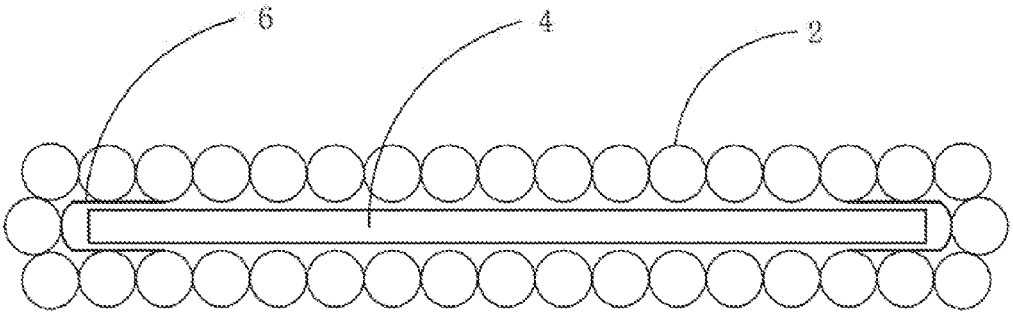
FIG. 2 is a schematic view showing a package that uses a package cushioning material for liquid crystal glass according to a first embodiment of the present invention.
Figure 3:
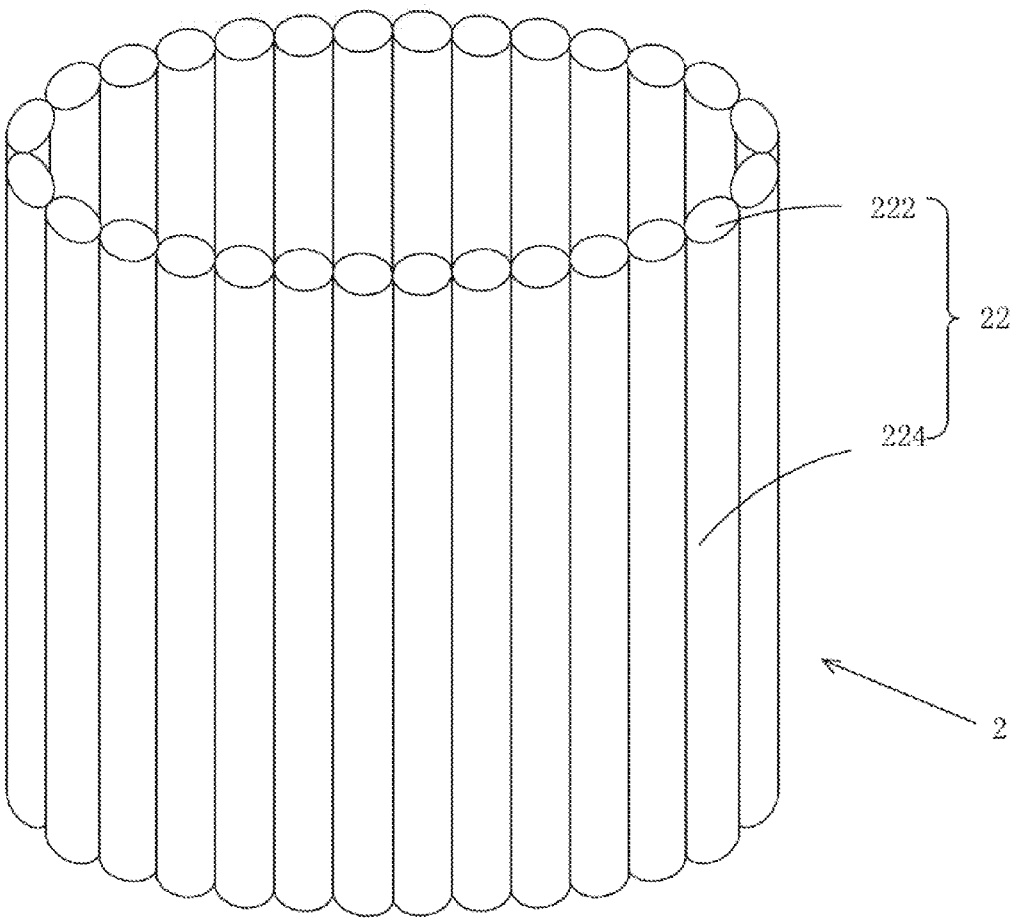
FIG. 3 is a perspective view of an annulus air sack sheet serving as package cushioning material for liquid crystal glass according to the present invention.

Referring to FIGS. 2 and 3, a first embodiment of the present invention provides a package cushioning material for liquid crystal glass, which comprises an air sack sheet 2 and scratch protection layer 6 arranged at contact sites between the air sack sheet 2 and four corners of the liquid crystal glass 4. The air sack sheet 2 is formed by successively connecting a plurality of air sacks 22. The air sack sheet 2 is integrally formed.

The air sacks 22 each comprise two end faces 222 and a columnar face 224 connecting between the two end faces 222. The columnar faces 224 of the plurality of air sacks 22 are jointed to each other to form an annulus configuration.

The scratch protection layers 6 are each a piece of single-sided adhesive tape and are adhered to the portions of the air sack sheet 2 that correspond to the four corners of the liquid crystal glass 4.

To make a package, the scratch protection layers 6 are first adhered to the portions of the columnar faces 224 of the air sack sheet 2 that correspond to the four corners of the liquid crystal glass 4. And, then the liquid crystal glass 4 is deposited into the air sack sheet 2 in such a way that the four corners of the liquid crystal glass 6 positioned on the scratch protection layers 6 to prevent the liquid crystal glass 4 from scratching and breaking the air sacks 22 due to vibrations occurring during loading/unloading and transportation thereby ensure that the air sacks 22 can make full use of the cushioning capability thereof to protect the liquid crystal glass 4 from being damaged.

Figure 4:
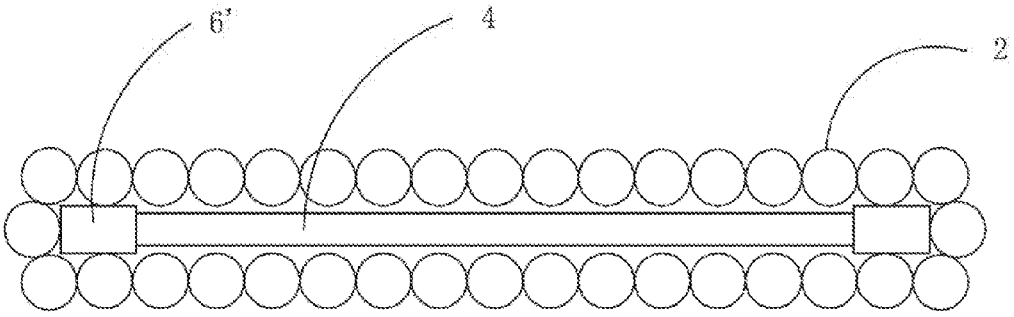
FIG. 4 is a schematic view showing a package that uses a package cushioning material for liquid crystal glass according to a second embodiment of the present invention.
Figure 5:
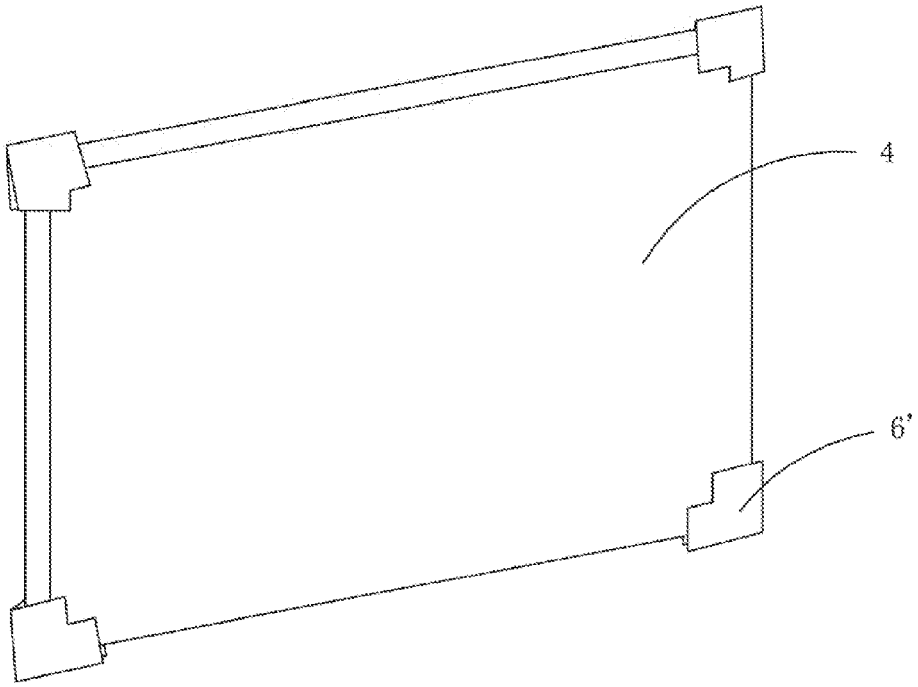
FIG. 5 is a perspective view showing thin films of a package cushioning material for liquid crystal glass according to a second embodiment of the present invention attached to four corners of a piece of liquid crystal glass.

Referring to FIGS. 4-5, a package cushioning material for liquid crystal glass according to a second embodiment of the present invention is schematically shown. In the instant embodiment, the scratch protection layers 6' are thin films. The thin films can be PE (Polyethylene) films or PET (Polyethylene Terephthalate) films attached to the four corners of the liquid crystal glass 4.

To make a package, the scratch protection layers 6' are first adhered to the four corners of the liquid crystal glass 4. And, then the liquid crystal glass 4 is deposited into the air sack sheet 2 in such a way that the four corners of the liquid crystal glass 4 are separated by the scratch protection layers 6' so as not to directly contact the air sacks 22 thereby preventing the liquid crystal glass 4 from scratching and breaking the air sacks 22 due to vibrations occurring during loading/unloading and transportation and thus ensuring that the air sacks 22 can make full use of the cushioning capability thereof to protect the liquid crystal glass 4 from being damaged.

Figure 6:
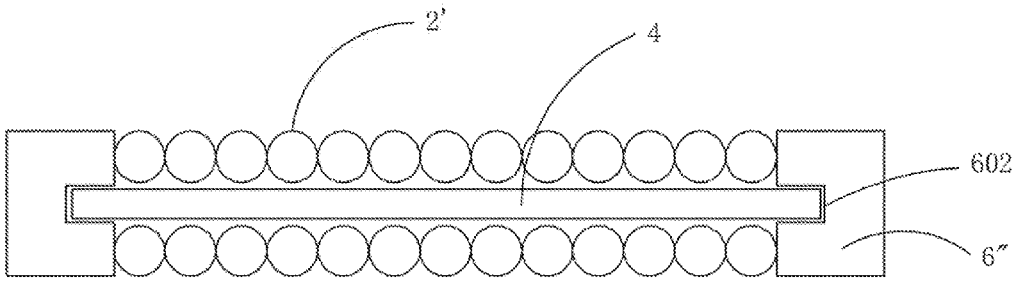
FIG. 6 is a schematic view showing a package that uses a package cushioning material for liquid crystal glass according to a third embodiment of the present invention.
Figure 7:
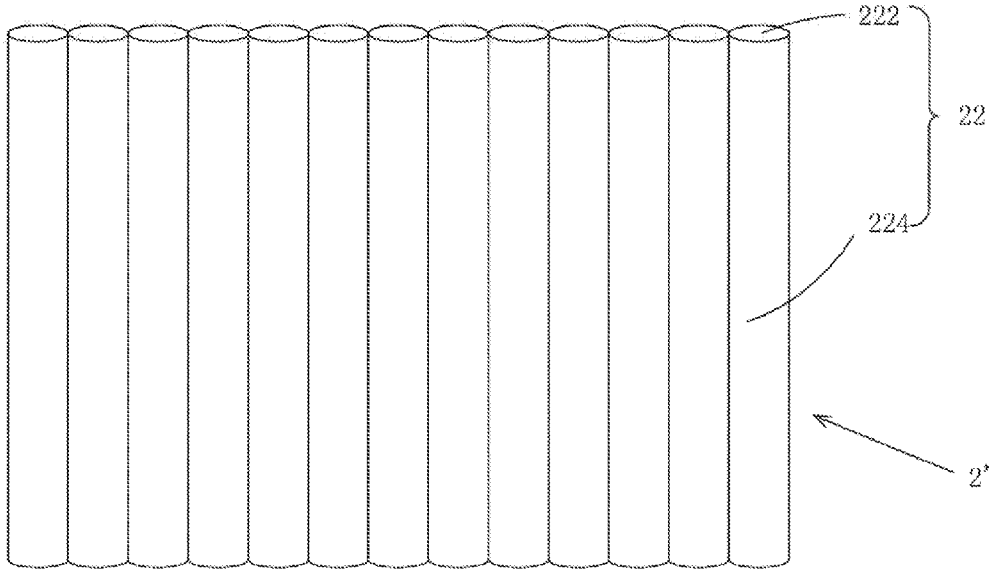
FIG. 7 is a perspective view of an annulus air sack sheet serving as package cushioning material for liquid crystal glass according to the present invention.

Referring to FIGS. 6 and 7, a package cushioning material for liquid crystal glass according to a third embodiment of the present invention is schematically shown. The air sack sheet 2' is formed by connecting a plurality of air sacks 22 together to show a plate like configuration. The air sack sheet 2' is integrally formed.

The air sacks 22 each comprises two end faces 222 and a columnar face 224 connecting between the two end faces 222. The columnar faces 224 of the plurality of air sacks 22 are jointed to each other.

The scratch protection layers 6" are made of a foamed PE cushioning material and form U-shaped channels 602 corresponding to the liquid crystal glass 4. The U-shaped channels 602 have a width greater than or equal to thickness of the liquid crystal glass 4 to allow the liquid crystal glass 4 to be receive din the U-shaped channels 602. The scratch protection layers 6" are of a number of two. The air sack sheet 2' comprises two pieces that are respectively connected to two ends of the two scratch protection layers 6" and are respectively bonded to opposite surfaces of the liquid crystal glass 4.

To make a package, two opposite edges of the liquid crystal glass 4 are respectively fit into the U-shaped channels of two scratch protection layers 6". And then, two air sack sheets 2' are respectively attached to opposite surfaces of the liquid crystal glass 4 with the columnar faces 224 at ends of the air sack sheets 2' respectively connected to two ends of the scratch protection layers 6" thereby preventing the liquid crystal glass 4 from scratching and breaking the air sacks 22 due to vibrations occurring during loading/unloading and transportation and thus ensuring that the air sacks 22 can make full use of the cushioning capability thereof to protect the liquid crystal glass 4 from being damaged.

In summary, the present invention provides a package cushioning material for liquid crystal glass, which uses an air sack sheet as a basic material to be used in combination with scratch protection layers arranged at contact sites of the air sack sheet with the four corners of the liquid crystal glass so as to prevent the liquid crystal glass from scratching and breaking the air sacks thereby providing improved effect of cushioning and thus highly effective protection of the liquid crystal glass during transportation.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A package cushioning material for liquid crystal glass, comprising an air sack sheet and two scratch protection layers, the air sack sheet being formed by connecting a plurality of air sacks;

wherein each of the air sacks is in the form of a cylindrical column that comprises two end faces and a columnar face extending in a predetermined direction and connecting between the end faces, the columnar faces of the plurality of air sacks being jointed to each other;

wherein the air sack sheet is set along and substantially parallel to one of two opposite major surfaces of the liquid crystal glass;

wherein the scratch protection layers are respectively arranged at two opposite ends of the liquid crystal glass that each connect between the two major surfaces of the liquid crystal glass, each of the scratch protection layers is made of a foamed cushioning material and forms a U-shaped channel corresponding to the end of the liquid crystal glass, the U-shaped channels having a width greater than or equal to a thickness of the liquid crystal glass between the two major surfaces so as to receive the end of the liquid crystal glass therein with the end face of the liquid crystal glass being concealed in the U-shaped channel; and wherein the air sack sheet is arranged between the two U-shaped channels and is separated from the ends of the liquid crystal glass by the U-shaped channels.

2. The package cushioning material for liquid crystal glass as claimed in claim 1, wherein the air sack sheet is integrally formed.

3. The package cushioning material for liquid crystal glass as claimed in claim 1, wherein the air sack sheet is of a plate-like configuration.

4. The package cushioning material for liquid crystal glass as claimed in claim 1, further comprising an additional air sack sheet that is formed by by connecting a plurality of air sacks and is set along and substantially parallel to an opposite one of the two major surfaces of the liquid crystal glass.

5. The package cushioning material for liquid crystal glass as claimed in claim 4, wherein the additional air sack sheet is arranged between the two U-shaped channels and is separated from the ends of the liquid crystal glass by the U-shaped channels.

6. The package cushioning material for liquid crystal glass as claimed in claim 4, wherein the additional air sack sheet is of a plate-like configuration.

7. The package cushioning material for liquid crystal glass as claimed in claim 1, wherein the foamed cushioning material is a foamed polyethylene material.

8. A package cushioning material for liquid crystal glass, comprising two air sack sheets and two scratch protection layers, each of the air sack sheets being formed by connecting a plurality of air sacks;

wherein each of the air sacks is in the form of a cylindrical column that comprises two end faces and a columnar face extending in a predetermined direction and connecting between the end faces, the columnar faces of the plurality of air sacks being jointed to each other;

wherein the air sack sheets are respectively set along and substantially parallel to two opposite major surfaces of the liquid crystal glass;

wherein the scratch protection layers are respectively arranged at two opposite ends of the liquid crystal glass that each connect between the two major surfaces of the liquid crystal glass, each of the scratch protection layers is made of a foamed cushioning material and forms a U-shaped channel corresponding to the end of the liquid crystal glass, the U-shaped channels having a width greater than or equal to a thickness of the liquid crystal glass between the two major surfaces so as to receive the end of the liquid crystal glass therein with the end face of the liquid crystal glass being concealed in the U-shaped channel; and wherein the air sack sheets are each arranged between the two U-shaped channels and separated from the ends of the liquid crystal glass by the U-shaped channels.

9. The package cushioning material for liquid crystal glass as claimed in claim 8, wherein the air sack sheets are each is integrally formed.

10. The package cushioning material for liquid crystal glass as claimed in claim 8, wherein the air sack sheets are each of a plate-like configuration.

11. The package cushioning material for liquid crystal glass as claimed in claim 8, wherein the foamed cushioning material is a foamed polyethylene material.

* * * * *